United States Patent [19]

Eickerman

[11] 4,267,776

[45] May 19, 1981

[54] MUZZLE VELOCITY COMPENSATING APPARATUS AND METHOD FOR A REMOTE SET FUZE

[75] Inventor: Curtis L. Eickerman, Phoenix, Ariz.

[73] Assignee: Motorola, Inc., Schaumburg, Ill.

[21] Appl. No.: 53,617

[22] Filed: Jun. 29, 1979

[51] Int. Cl.[3] ..... F42C 11/06

[52] U.S. Cl. ..... 102/215; 102/276; 89/6

[58] Field of Search ..... 102/276, 215; 343/8; 89/6

[56] References Cited

U.S. PATENT DOCUMENTS

| | | | |
|---|---|---|---|
| 2,752,593 | 6/1956 | Downs | 343/8 |
| 3,034,049 | 5/1962 | Downs | 343/8 |
| 3,256,519 | 6/1966 | Dewey et al. | 343/8 |
| 3,365,716 | 1/1968 | Jorgensen | 343/8 |
| 3,688,701 | 9/1972 | Kern | 102/215 |
| 3,714,898 | 2/1973 | Ziemba | 102/215 |
| 3,768,097 | 10/1973 | Ziegler | 343/9 |
| 3,844,217 | 10/1974 | Ziemba | 102/276 |
| 3,918,061 | 11/1975 | Elgaard | 343/8 |

*Primary Examiner*—Charles T. Jordan

*Attorney, Agent, or Firm*—Eugene A. Parsons

[57] ABSTRACT

A desired range is selected prior to firing the projectile carrying the remote set fuze and after firing a Doppler radar provides Doppler pulses proportional to the relative velocity of the projectile. Constant frequency pulses are counted during a predetermined number of the Doppler pulses to provide an indication of the actual velocity of the projectile and the preselected range-to-function is achieved by means of a time-to-function adjustment to compensate for differences between the actual velocity and a predicted velocity. The adjusted time-to-function is transmitted to the remote set fuze in a coded form.

12 Claims, 4 Drawing Figures

MIXER
DOPPLER PRE-AMP
LIMITER
RECTIFY AND FILTER
DOPPLER DETECT LATCH
CLKD LATCH
BUFFER
÷10
P.E.
R
CLK
Co
÷2
TRANSMISSION GATE
1 MHZ XTAL OSC
12 STAGE CNTR
VALID VELOCITY DECODE
ROM SELECT DECODE
10
11
12
13
14
20
21
22
23
25
27
28
30
31
34
35
36
40
41
42
45
46
50
51
52
53
55
56
60
61

MUZZLE VELOCITY COMPENSATING APPARATUS AND METHOD FOR A REMOTE SET FUZE

BACKGROUND OF THE INVENTION

Remote set fuzes for projectiles, such as artilery shells and the like, are well known in the art, a typical fuze being disclosed in U.S. Pat. No. 3,688,701, issued Sept. 5, 1972 and entitled "Command Fuze". In the use of remote set fuzes, a desired range is usually determined and this range is communicated to the fuze after the projectile is fired. Information as to the range is based upon a nominal, or predicted, muzzle velocity of the projectile which determines the time of flight (range) of the projectile. In many cases the actual velocity of the projectile will differ from the predicted velocity, because of differences in the charge propelling the projectile, differences in air currents and temperatures, etc. These variations between the actual and predicted velocities can produce substantial differences in the ultimate range, or position of detonation, of the projectile.

SUMMARY OF THE INVENTION

The present invention pertains to muzzle velocity compensating apparatus and method for a remote set fuze wherein a desired range is preset into the apparatus and a projectile carrying a remote set fuze is fired, after which a Doppler radar transceiver is utilized to provide Doppler pulses proportional to the relative velocity of the projectile and a predetermined number of the Doppler pulses are timed to determine the actual velocity of the projectile and adjust the time-to-function for the selected range in accordance with the difference between the predicted velocity and the measured velocity.

It is an object of the present invention to provide muzzle velocity compensating apparatus and methods for use in conjunction with a remote set fuze.

It is a further object of the present invention to provide muzzle velocity compensating apparatus wherein a desired range is selected on the basis of a predicted velocity and the actual time-to-function is adjusted in accordance with a measured velocity of the projectile.

It is a further object of the present invention to provide muzzle velocity compensating apparatus wherein the actual velocity of a projectile is determined by timing a predetermined number of Doppler pulses and a preselected range-to-function is achieved by means of a time-to-function adjustment in accordance with the actual velocity.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures.

DESCRIPTION OF THE PREFERRED EMBODIMENT

Figure 1:
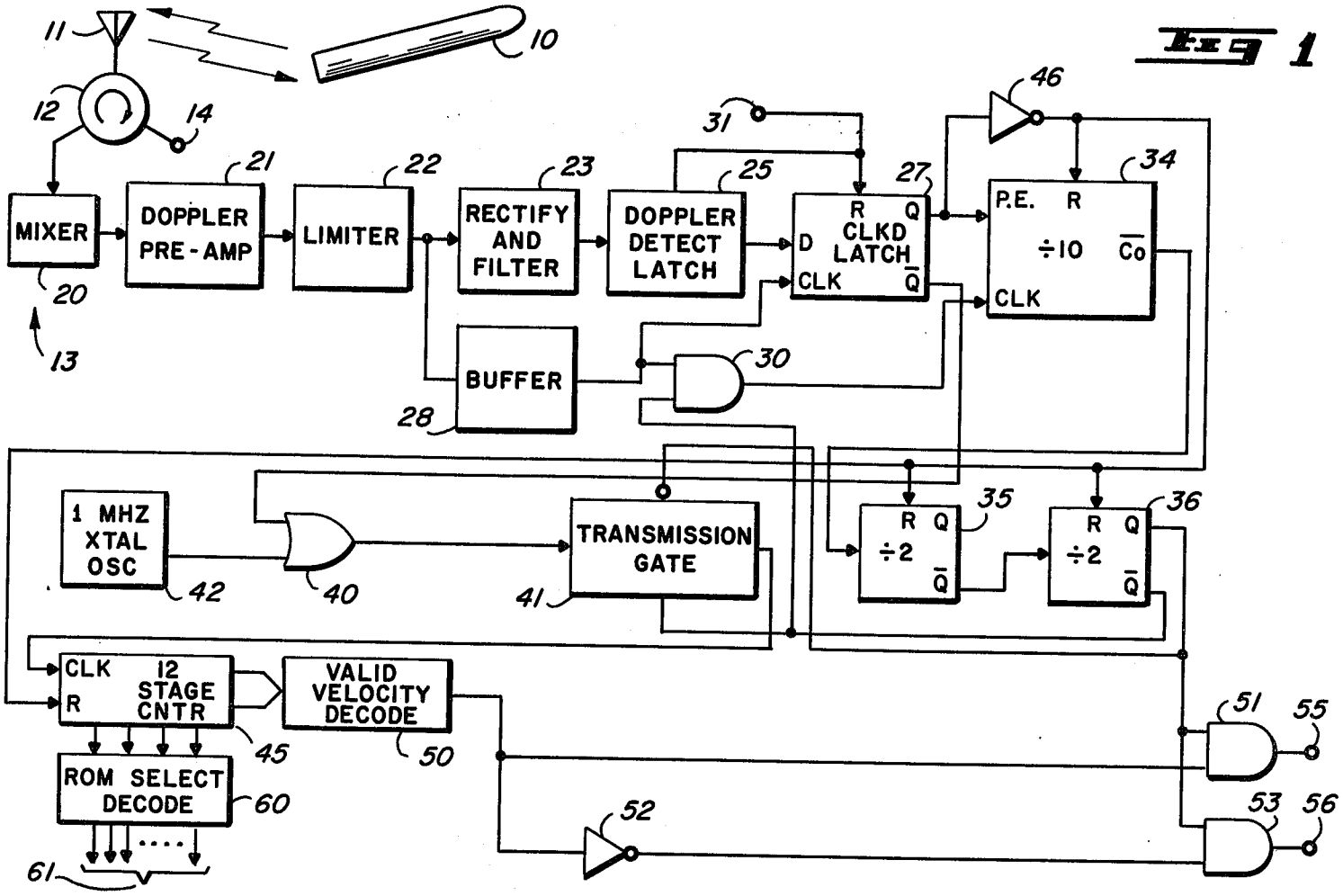
FIGS. 1 and 2 are a block diagram of remote set apparatus for a fuze and muzzle velocity compensating apparatus incorporated therein, which embodies the present invention.

Referring specifically to FIG. 1, a projectile carrying a remote set fuze is designated 10. The projectile 10 is in communication with an antenna 11, which is connected through a circulator 12 to a receiver, generally designated 13, and by way of a terminal 14 to a transmitter, generally designated 15 (see FIG. 2). The antenna 11, circulator 12, receiver 13 and transmitter 15 form a Doppler radar transceiver which provides Doppler signals proportional to the relative velocity of the projectile 10. The Doppler signals are produced in any standard fashion by the use of a mixer 20 in the receiver 13 and are available at the output thereof in the form of a generally sinusoidal continuous pattern. While substantially any desired Doppler radar transceiver might be utilized to provide the Doppler signals, a simplified form is illustrated herein for the purpose of simplifying this description.

The Doppler signal from the mixer 20 is amplified in a preamplifier 21 and the signal is limited in limiter 22 to produce generally square output Doppler pulses. These Doppler pulses are rectified and filtered in a circuit 23 and applied to a Doppler detection latch 25. The detection latch is a relatively well known circuit which simply detects the presence of Doppler pulses and provides a constant output signal upon the receipt of a Doppler pulse at the input thereof. This constant output signal is applied to a clocked latch 27 which is essentially an astable flip-flop. Simultaneously, the Doppler pulses from the limiter 22 are applied through a buffer 28 to a clock input of the latch 27 and to one input of an AND gate 30. The latch 25 and buffer 28 ensure that the latch 27 operates at the beginning of a Doppler pulse. The latches 25 and 27 are reset by a pulse on a terminal 31, which pulse is developed in the apparatus illustrated in FIG. 2 and will be described in conjunction therewith.

The Q or high output of the latch 27 is connected to an enable input of a divide by ten circuit 34. Simultaneously the Doppler pulses are applied through the buffer 28 and AND gate 30 to a clock input of the divide-by-ten circuit 34. The output of the circuit 34 is connected to the input of a divide-by-two (flip-flop) circuit 35, the low ($\overline{Q}$) output of which is connected to the input of a second divide-by-two circuit 36. The $\overline{Q}$ output of the second divide-by-two circuit 36 is connected to a second input of the AND gate 30 so that the AND gate 30 passes Doppler pulses until the final divide-by-two circuit 36 operates. Thus, these circuits 34, 35 and 36 count exactly twenty Doppler pulses.

The $\overline{Q}$ output of the latch 27 is connected to one input of an OR gate 40, the output of which is connected to the input of a transmission gate 41. A second input of the OR gate 40 is connected to the output of a 1 megahertz crystal oscillator 42. When the latch 27 is reset the $\overline{Q}$ output closes the gate 40 so that the output of the oscillator 42 is not applied to the transmission gate 41. When the latch 27 is operated the $\overline{Q}$ output disappears and timing pulses from the oscillator 42 are applied through the OR gate 40 to the transmission gate 41. At this time the $\overline{Q}$ output of the divide-by-two circuit 36 is high and the Q output is low so that the transmission gate 41 passes the timing pulses to the input of a twelve stage counter 45. When the twentith Doppler pulse switches the divide-by-two circuit 36 the transmission gate 41 is closed and no more timing pulses from the oscillator 42 are applied to the counter 45. Thus, the counter 45 counts timing pulses from the oscillator 42 for exactly twenty Doppler pulses. The Q output of the latch 27 is also applied through an inverter 46 to reset inputs of the circuits 34, 35 and 36 and the counter 45 so that all of these circuits are returned to zero prior to the beginning of the first Doppler pulse which operates the latch 27. It should of course be understood that the number of Doppler pulses counted by the circuits 34, 35 and 36, the frequency of the oscillator 42 and the number of stages in the counter 45 are selected for purposes of this description and substantially any desired compatible numbers may be selected.

Since the Doppler pulses are proportional to the relative velocity of the projectile 10, the count in the counter 45 is also proportional to the relative or actual velocity of the projectile 10. The present apparatus compensates for differences in velocity in projectiles, but in some instances the velocity of a projectile may be so far from normal that compensation is not possible. In other words, the compensating apparatus will generally have a range of velocities for which it is capable of compensating and any projectiles travelling with a velocity outside of this range cannot be compensated and the circuitry will automatically be deactivated, as will be described in detail presently. A plurality of the most significant bits of the output of counter 45 are utilized to determine whether the projectile 10 is within the compensatible range. This plurality of most significant bits is applied to a valid velocity decode circuit 50. The decode circuit 50 simply determines whether the count in the counter 45 is within a certain predetermined range. For example, any count in the counter 45 corresponding to projectile velocities between 20,000 and 30,000 ft/sec (which may be represented in binary by 000110010000 to 000110011111, where the first eight bits are the most significant bits and the last four are the least significant bits) may be considered valid and the decode circuit 50 simply looks at the eight most significant bits to determine whether the count lies between these limits. If the count is in the desired range the decode circuit 50 supplies an output to one input of an AND gate 51 and, simultaneously, the output is supplied through an inverter 52 to one input of a second AND gate 53. Also, the Q output of the divide by two circuit 36 is connected to second inputs of each of the gates 51 and 53. Thus, when the twentith Doppler pulse operates the circuit 36 both gates 51 and 53 are opened. If an output is produced by the decode circuit 50 the gate 51 produces an output at a terminal 55, which output indicates that the count is finished and the velocity is valid. If no output is produced by the decode circuit 50 the inverter 52 operates the gate 53 to produce an output at a terminal 56, which output indicates that the count is finished and the velocity is invalid.

Figure 2:
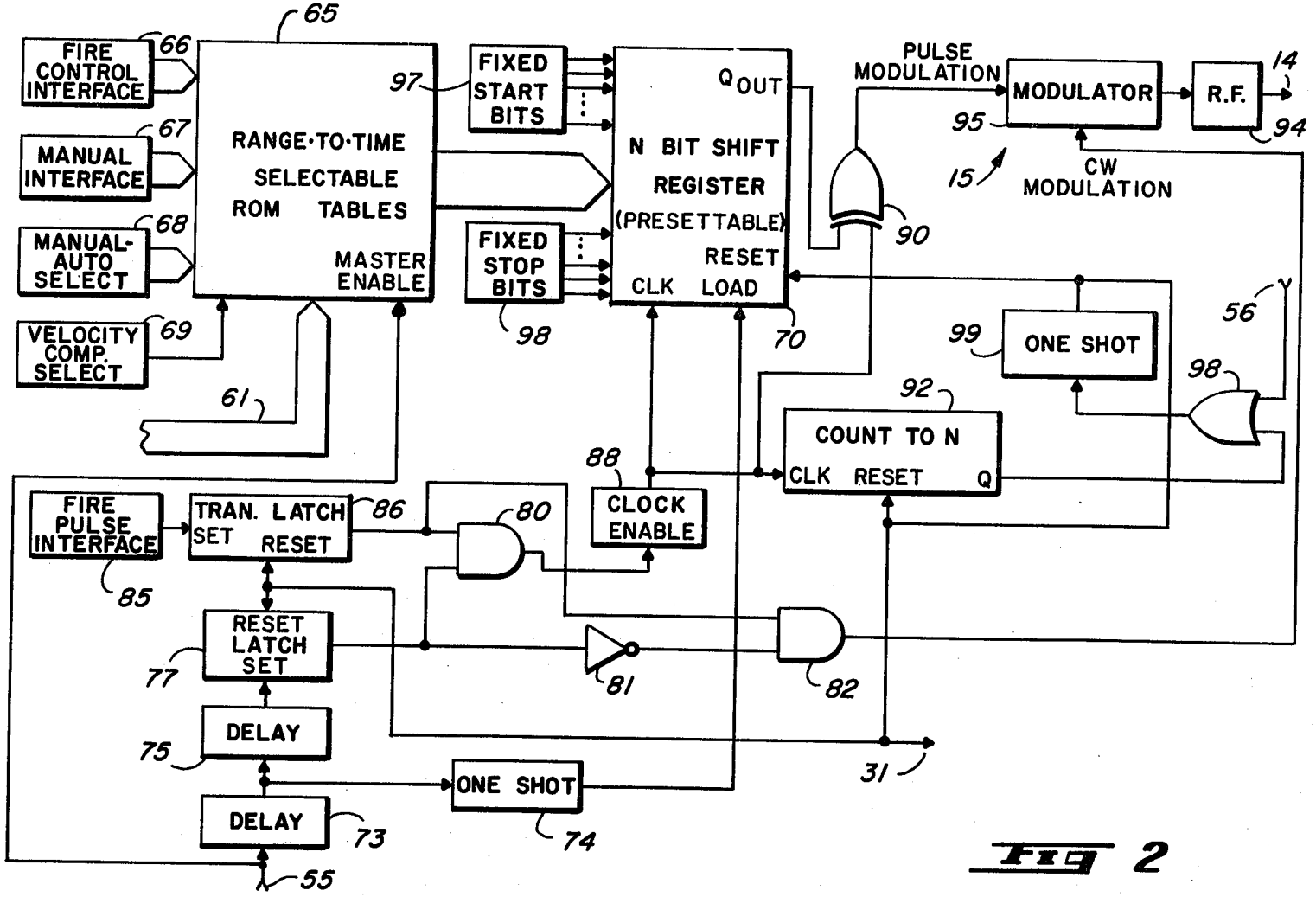

Simultaneous with the valid/invalid signals produced by the most significant bits from the counter 45, the least significant bits are applied to a read only memory (ROM) select decode circuit 60. The decode circuit 60 is simply a hardwired circuit that converts the least significant bits (4 in this example) to signals on a plurality of wires, designated 61, utilized to select a specific ROM in a look-up table to be described presently. The ROM look-up tables are illustrated in FIG. 2 as block 65. In addition to the ROM select lines 61 from the decode circuit 60, the tables 65 have four other inputs for selecting the desired ROM. A first input, designated 66, is a fire control interface which is utilized to automatically input a range selected by the fire control unit. A second input 67 is a manual interface which allows an operator to manually set a desired range into the table 65. A third input 68 is a manual/automatic select circuit which simply determines whether the input 66 or the input 67 is controlling. A fourth input 69 is a velocity compensation select circuit which essentially causes the tables 65 to accept compensation from the present circuitry on the ROM select lines 61 or to ignore the compensation and to select the ROM representative of the preselected range at the nominal or predicted velocity. The ROM tables 65 are enabled by an input on the terminal 55 (finished count and velocity valid).

With the ROM tables 65 enabled and a specific ROM selected, signals are supplied in parallel on a plurality of output leads to a shift register 70. The "finished count and velocity valid" signal at the terminal 55 is applied through a delay circuit 73 to a one shot multivibrator 74 and a second delay circuit 75. The delay circuit 73 allows time for the operation of the ROM tables 65. The one shot multivibrator 74 applies a load signal to the shift register 70 to load signals from the specific ROM in the tables 65 into the shift register 70. The delay 75 allows time for the loading of the shift register 70 after which a latch 77 is set. An output signal from the latch 77 is applied to one input of a first AND gate 80 and, through an inverter 81, to one input of a second AND gate 82. A fire pulse interface 85 generates a pulse when the projectile 10 is fired, which pulse is utilized to set a transmit latch 86. The output of the transmit latch 86 is connected to second inputs of both AND gates 80 and 82. If both latches 77 and 86 are set the AND gate 80 enables a clock 88 which supplies clock pulses to the shift register 70 to clock the information out of the register on an output connected to an exclusive OR gate 90. The pulses from the clock 88 are also supplied to a counter 92 which has the same count (N) as the number of bits in the shift register 70. The output of the clock 88 is also connected to a second input of the exclusive OR gate 90. Thus, when a fire pulse is generated by the interface 85 and a "valid" pulse appears at the terminal 55 the clock 88 is enabled to clock information from the shift register 70 through the exclusive OR gate 90. The clock pulses from the clock 88 are also applied to the exclusive OR gate 90 so that the output thereof is applied to a modulator 95 to biphase modulate RF signals generated in an RF section 94 of the transmitter 15. Added start and stop commands can be loaded into the shift register 70 by means of presettable fixed start bits 97 and presettable fixed stop bits 98.

Prior to setting the latch 77 with the "finished count and velocity valid" pulse at the terminal 55, the inverter 81 causes the AND gate 82 to supply a signal to the modulator 95 which produces CW modulation of the RF signal in the RF section 94 so that Doppler signals can be received in the receiver 13. Thus, in this embodiment the transmitter 15 is utilized as a Doppler radar transmitter and to communicate with the remote set fuze in the projectile 10. It will of course be understood by those skilled in the art that separate transmitters might be utilized for these two functions, but it is believed that the use of a single transmitter as disclosed simplifies the apparatus and reduces the amount of apparatus required. Further, while the modulator 95 biphase modulates the RF signal through the operation of the exclusive OR gate 90, it will be understood that other types of modulation might be utilized and that the present is disclosed herein because of its simplicity.

"Finished count and velocity invalid" pulses appearing at the terminal 56 are applied to one input of an OR gate 98 and a second input is connected to the output of the counter 92. The output of the OR gate 98 is connected to a one shot multivibrator 99, the output of which is connected to reset inputs of the shift register 70, counter 92, latch 77 and latch 86 and the terminal 31, which is connected to reset inputs of the latches 25 and 27 of FIG. 1. Thus, when the counter 45 and velocity decoder 50 indicate that the velocity of the projectile is invalid (not compensatable) the invalid pulse at the terminal 56 resets the entire apparatus so that it is ready for the next projectile firing.

Figure 3:
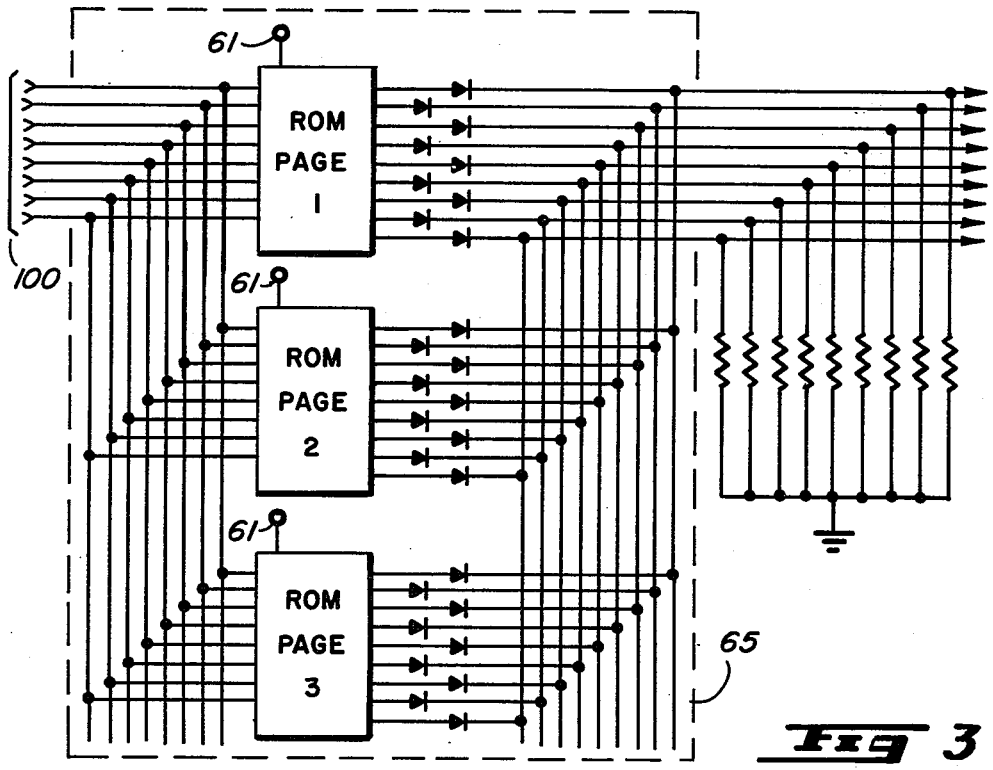
FIG. 3 is a detailed block diagram and schematic for a portion of the apparatus illustrated in FIG. 2.
Figure 4:
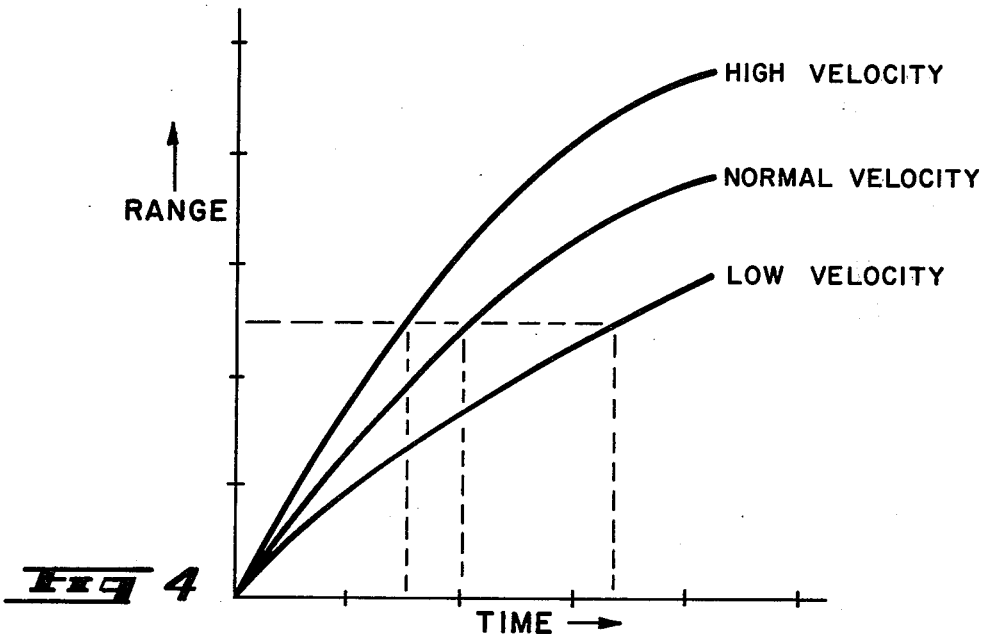
FIG. 4 graphically illustrates range-time curves for the apparatus of FIG. 3.

The range to time selectable ROM tables 65 are illustrated in a simplified form in FIG. 3. In FIG. 3 a selected range, from either the fire control interface 66 or the manual interface 67, is applied on the plurality of lines designated 100. This selected range is applied to all of the ROMs (3 in this simplified embodiment) simultaneously and a specific ROM is selected by means of the select lines 61 from the decode circuit 60 (see FIG. 1). For each different muzzle velocity a different range versus time curve may be plotted for the projectile as shown in FIG. 4. As can be seen from the curves of FIG. 4, when a specific range is required the actual fuze time setting must be based upon the initial shell velocity. Therefore, it is desirable to select the proper range versus time graph to correspond to measured shell velocity when converting the desired range to a time setting. The range to time selectable ROM tables 65 perform this function. Each ROM page contains all of the data associated with the range versus time curve for a specific muzzle velocity, e.g., the high velocity curve of FIG. 4 is contained in ROM page 1 of FIG. 3, the normal velocity curve of FIG. 4 is contained in ROM page 2 of FIG. 3, etc. Access to the proper page of the ROM tables is by means of the separate select lines 61 from the decode circuit 60, with each separate select line corresponding to a specific muzzle velocity. While only three different muzzle velocities are illustrated in the simplified drawings of FIGS. 3 and 4, it will be understood by those skilled in the art that any number of velocities desired, or required, may be utilized. Therefore, actual shell velocity is measured in the compensating apparatus and the appropriate enable line of the ROM tables 65 is energized to select the corresponding range to time conversion ROM (page) to allow the appropriate time setting to be loaded into the shift register 70 for transmission to the remote set fuze of the projectile 10.

When the counter 92 indicates that all of the bits of information have been shifted out of the shift register 70 and transmitted, an output signal is applied through the OR gate 98 to operate the one shot multivibrator 99 which resets all of the circuitry and prepares it for the next firing. With the latch 77 reset the inverter 81 causes the AND gate 82 to be prepared to switch the modulator 95 to the CW mode of operation when the transmit latch 86 is set by the next signal from the fire pulse interface 85 so that the receiver 13 and transmitter 15 again operate as a Doppler radar transceiver. Since the ROM page 2 of FIG. 3 contains the profile for a normal velocity, if the velocity compensation select circuit 69 is operated to deenergize the compensating apparatus, the ROM page 2 is continuously in the circuit. While switches for this operation are not specifically shown in FIG. 3, such circuitry is readily apparent to those skilled in the art.

Therefore, muzzle velocity compensating apparatus is disclosed which provides increased accuracy for remote set fuzes. Further, the shift register 70 and associated circuitry provide means for coding the time settings selected in the ROM tables 65, but it will be understood by those skilled in the art that other means for conveying these time settings to the projectile 10 may be devised. While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

I claim:

1. Muzzle velocity compensating apparatus for a remote set fuze comprising:

(a) a source of constant frequency timing pulses;

(b) a Doppler radar transceiver mounted to provide Doppler pulses proportional to the relative velocity of a projectile carrying a remote set fuze;

(c) a counter connected to be activated for a predetermined number of Doppler pulses from said transceiver and to count timing pulses from said source during the activated period;

(d) decode means connected to said counter for utilizing the pulse count to provide an indication of the measured velocity of the projectile;

(e) range set means for presetting an operating time corresponding to a desired range into the apparatus utilizing a predicted projectile velocity; and (f) means coupled to said range set means and said decode means for adjusting the corresponding time for said preset range to compensate for differences between the predicted velocity and the measured velocity.

2. Muzzle velocity compensating apparatus as claimed in claim 1 wherein the range set means includes range to binary code conversion apparatus.

3. Muzzle velocity compensating apparatus as claimed in claim 2 wherein the conversion apparatus includes read-only-memory tables.

4. Muzzle velocity compensating apparatus as claimed in claim 1 wherein the adjusting means has a maximum adjustability range and the compensating apparatus includes a sensing decoder connected to the counter and providing an indicating signal coupled to prevent operating of the apparatus when the total count in the counter is beyond the count representative of the maximum adjustability range.

5. Muzzle velocity compensating apparatus as claimed in claim 4 wherein the counter has a parallel output with a plurality of the most significant bits being connected to the sensing decoder.

6. Muzzle velocity compensating apparatus for a remote set fuze comprising:

(a) range set means for presetting an operating time corresponding to a desired range into the apparatus utilizing a predicted projectile velocity;

(b) a Doppler radar transceiver mounted to provide Doppler pulses proportional to the relative velocity of a projectile carrying a remote set fuze;

(c) timing means connected to receive the Doppler pulses and providing signals indicative of the elapsed time for a predetermined number of the Doppler pulses; and (d) means coupled to said range set means and said timing means for adjusting the corresponding operating time for said preset range to compensate for differences between the predicted velocity and the measured velocity.

7. Muzzle velocity compensating apparatus as claimed in claim 6 including means for converting the adjusted operating time for the selected range to an electrical signal for transmission to the remote set fuze.

8. Muzzle velocity compensating apparatus as claimed in claim 7 wherein the adjusting means includes a read-only-memory look-up table.

9. Muzzle velocity compensating apparatus as claimed in claim 8 wherein the converting means includes a shift register.

10. A method of compensating for differences between predicted and actual muzzle velocities in a projectile carrying a remote set fuze comprising the steps of:

(a) preselecting a desired range and firing the projectile;

(b) providing a train of Doppler pulses returned from the projectile and proportional to the relative velocity of the projectile;

(c) measuring the elapsed time for a predetermined number of the Doppler pulses to indicate the actual muzzle velocity of the projectile; and (d) developing a signal for use in setting apparatus in the remote set fuze to the preselected range at the indicated actual muzzle velocity.

11. A method of compensating for differences between predicted and actual muzzle velocities in a projectile carrying a remote set fuze comprising the steps of:

(a) preselecting a desired range utilizing a predicted projectile velocity and firing the projectile;

(b) providing a train of Doppler pulses returned from the projectile and proportional to the relative velocity of the projectile;

(c) providing constant frequency timing pulses;

(d) counting the timing pulses for a predetermined number of the Doppler pulses to indicate the actual muzzle velocity of the projectile; and (e) developing a signal for use in setting apparatus in the remote set fuze to the preselected range at the indicated actual muzzle velocity.

12. A method of compensating for differences between predicted and actual muzzle velocities in a projectile carrying a remote set fuze comprising the steps of:

(a) preselecting a desired range utilizing a predicted projectile velocity and firing the projectile;

(b) providing a train of Doppler pulses returned from the projectile and proportional to the relative velocity of the projectile;

(c) providing constant frequency timing pulses;

(d) counting the timing pulses for a predetermined number of the Doppler pulses to indicate the actual muzzle velocity of the projectile; and (e) adjusting the firing time of the remote set fuze to compensate for the difference between the predicted velocity and the indicated actual velocity.

* * * * *